US007555921B2

(12) United States Patent
Thompson et al.

(10) Patent No.: US 7,555,921 B2
(45) **Date of Patent: *Jul. 7, 2009**

(54) KNITTED GLOVE WITH CONTROLLED STITCH STRETCH CAPABILITY AND ENHANCED CUFF

(75) Inventors: Eric Thompson, Central, SC (US); Jeffrey C. Moreland, Pendleton, SC (US); Gerardo Rodriguez Garay, Juarez (MX); Norberto Hector Perales Solis, Ciudad Juarez (MX); Dave Narasimhan, Flemington, NJ (US)

(73) Assignee: Ansell Healthcare Products LLC, Red Bank, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/209,529

(22) Filed: Sep. 12, 2008

(65) Prior Publication Data

US 2009/0044571 A1 Feb. 19, 2009

Related U.S. Application Data

(63) Continuation-in-part of application No. 11/444,806, filed on Jun. 1, 2006, now Pat. No. 7,434,422, which is a continuation-in-part of application No. 11/181,064, filed on Jul. 13, 2005, now Pat. No. 7,213,419, which is a continuation-in-part of application No. 10/892,763, filed on Jul. 16, 2004, now Pat. No. 6,962,064.

(51) Int. Cl.
*D04B 9/58* (2006.01)

(52) U.S. Cl. ..... 66/174; 2/159

(58) Field of Classification Search ..... 66/174, 66/202, 159, 158, 161.6, 161.1
See application file for complete search history.

(56) References Cited

U.S. PATENT DOCUMENTS

| | | | |
|---|---|---|---|
| 5,187,815 | A | 2/1993 | Stern et al. |
| 5,231,700 | A | 8/1993 | Cutshall |
| 5,284,032 | A | 2/1994 | Shima |
| 5,511,394 | A | 4/1996 | Shima |
| 5,547,733 | A | 8/1996 | Rock et al. |
| 5,564,127 | A | 10/1996 | Manne |

(Continued)

FOREIGN PATENT DOCUMENTS

| | | |
|---|---|---|
| JP | 57-106753 | 7/1982 |

(Continued)

*Primary Examiner*—Danny Worrell
(74) *Attorney, Agent, or Firm*—Diehl Servilla LLC

(57) ABSTRACT

A knitted glove made by creating each of the at least fifteen sections using a separate knitting course on a flat knitting machine providing varying stitch dimensions with one or two yarns in one or more sections. Custom stretch characteristics can be provided using one or two yarns providing a tight glove that provides flexibility and ease of movement. The varying stitch dimension is achieved by 1) varying the depth of penetration of the knitting needle into fabric being knitted by a computer program, 2) adjusting the tension of yarn between a pinch roll and knitting head by a mechanism controlled by a computer and/or 3) casting off or picking up additional stitches in a course. The glove includes four finger components, a thumb component, two palm components, and a wrist component. A padded cuff section can be added to the wrist component for comfort.

20 Claims, 9 Drawing Sheets

U.S. PATENT DOCUMENTS

| | | | |
|---|---|---|---|
| 5,965,223 | A | 10/1999 | Andrews et al. |
| 6,044,493 | A | 4/2000 | Post |
| 6,155,084 | A | 12/2000 | Andrews et al. |
| 6,182,477 | B1 | 2/2001 | Shibata et al. |
| 6,550,285 | B2 | 4/2003 | Nishitani |
| 6,581,366 | B1 | 6/2003 | Andrews |
| 6,766,635 | B2 | 7/2004 | Andrews |
| 6,782,720 | B2 | 8/2004 | Vero et al. |
| 6,782,721 | B1 | 8/2004 | Vero et al. |
| 6,790,122 | B2 | 9/2004 | Mitchell et al. |
| 6,823,699 | B1 | 11/2004 | Vero et al. |
| 6,945,080 | B2 | 9/2005 | Maeda et al. |
| 6,962,064 | B1 | 11/2005 | Hardee et al. |
| 6,962,864 | B1 | 11/2005 | Jeng et al. |
| 2004/0055070 | A1 | 3/2004 | Maeda et al. |

FOREIGN PATENT DOCUMENTS

| | | |
|---|---|---|
| JP | 11-200123 | 7/1999 |
| JP | 2002-201515 | 7/2002 |
| JP | 2005-038116 | 2/2005 |

KNITTED GLOVE WITH CONTROLLED STITCH STRETCH CAPABILITY AND ENHANCED CUFF

CROSS-REFERENCE TO RELATED APPLICATIONS

This is a continuation-in-part of application Ser. No. 11/444,806, filed Jun. 1, 2006, which is a continuation-in-part of application Ser. No. 11/181,064, filed Jul. 13, 2005, now U.S. Pat. No. 7,213,419, which is a continuation-in-part of application Ser. No. 10/892,763, filed Jul. 16, 2004, now U.S. Pat. No. 6,962,064, the disclosures of which are hereby incorporated by reference in their entireties.

FIELD

The present invention relates to knitted gloves. More specifically, the invention relates to knitted gloves, knitted glove liners and novel methods of making them.

BACKGROUND

Knitted gloves are commonly used in handling and light assembly conditions. Knitted gloves of the prior art used for these purposes have been made using flat knitting machines that use a number of needles in the form of a needle array and a single yarn to knit the gloves using eight basic components to comprise the glove. These eight components include one component for each of the four fingers and thumb, two components for the palm including an upper section and a lower section, and one component for the wrist area. All of these sections according to the prior art are cylinders or conical sections that join to each other, fashioning the general anatomical shape of a hand. Conventional knitting processes use a knitting machine to knit each of these areas in a particular sequence, generally one finger at a time, beginning with the pinky finger and continuing on through the ring finger and middle finger to the forefinger. After one finger component is knitted using only selected needles in the needle array, the knitting process for this finger component is stopped and yarn is cut and bound. The knitted finger component is held by holders, weighted down by sinkers. Each remaining finger component is then knitted sequentially one at a time, each using a different set of needles in the needle array. After the four fingers are knitted in this fashion, the knitting machine then knits the upper section of the palm, picking stitches from each of the previously knit four fingers. The method of knitting individual fingers and picking stitches to knit the upper palm selection with better fitting crotches that are well fitted is discussed in U.S. Pat. No. 6,945,080 by Maeda, et al. After knitting an appropriate length of the upper palm, the thumb component is initiated using a separate set of needles in the needle array. Then the lower section of the palm is knit using all the needles in the needle array. Finally, the knitting machine knits the wrist component to the desired length.

The knitting stitches used at the fingertips are generally tighter than the stitches used elsewhere in the glove to improve the strength of the glove in this area where more pressure is likely to be applied. Depending on the size of the needles used and the denier of the yarn to knit the gloves, a certain number of courses are used to create each of the eight components of the glove. The finer the gauge of needle used, the higher the number of courses for each component to create the same size of a finished glove. Changing needles or the denier of a yarn is extremely difficult in a continuous process and generally a continuous yarn of pre-selected denier and a corresponding needle size is commercially used. While this standardization in needle size and number of courses permits the manufacturing of a glove or liner with a standard shape, that shape does not accommodate variations in size and shape of individual fingers and hands.

U.S. Pat. No. 5,284,032 to Shima discloses stitch control mechanism for a flat knitting machine. A stitch control mechanism is applicable for a flat knitting machine and controls loop size in a knit fabric. A spiral cam plate is attached to one surface of a stitch control cam. The spiral cam plate is held between a pair of cam rollers, and the pair of cam rollers is supported on a guide plate. The stitch cam has a portion slidably fitted in a guide slot formed in a base plate. The stitch dimension or loop size is controlled by the stitch control cam and can be changed by a computer program. This patent discloses the hardware necessary for stitch dimension control and does not disclose a knitted glove or liner with anatomic features providing improved fit.

U.S. Pat. No. 5,547,733 to Rock et al discloses plaited double-knit fabric. The composite fabric of terry construction includes an inner fabric layer made of a yarn comprising a plurality of hydrophilic treated polyester fibers and an outer fabric layer made of the same hydrophilic treated polyester fibers. The inner fabric layer and outer fabric layer are formed concurrently by a plaited knit construction so that the layers are distinct, yet integrated with one another. The textile fabric rapidly removes moisture from the skin of the user. This plaited double-knit fabric is tightly woven with the outer fabric layer that integrates with the inner fabric layer creating a double-knit article with limited stretchability.

U.S. Pat. No. 5,965,223 to Andrews et al discloses layered composite high performance fabric. The composite layered protective fabric has an outer primary layer composed of an abrasive material and an inner primary layer composed of an inherently cut-resistant material positioned below the outer primary layer. The inner layer, when assembled into a garment, is positioned proximate to the wearer's skin. A secondary layer may be added to the inner and outer layer framework and is composed of a material that provides additional protection against potential threats other than cuts, that increases comfort or that improves aesthetics. The composite fabric is continuously manufactured in a one-step process, which plates the primary abrasive and cut resistant yarn layers. The presence of multiple yarns tightly knitted together creates a knitted article that is stiff and does not accommodate complex shapes such as a glove. Every portion of the fabric thus formed is composed of the outer primary layer and the inner primary layer and no stretchable portions are provided within the fabric.

U.S. Pat. No. 6,155,084 to Andrews et al. discloses protective glove articles made of a continuously knit composite fabric. According to Andrews, these protective articles provide an unprecedented level of safety and comfort and are made of two or more dissimilar yarns including thermoplastics, elastomers, or metals forming primary, secondary and tertiary regions. The secondary region covers the thumb and palm and has superior cut resistance compared to the primary region which covers the finger stalls. The tertiary region covers the wrist portion and its cut resistance is between that of the primary and secondary regions. All the regions of the glove contain the cut resistant fibers and contain one or more fibers. The regions are not knitted with any stretchability and use of two yarns provides a tightly knitted fabric presenting a glove which has a tight uncomfortable feel. The protective article uses dissimilar fibers at selected protective fabric locations and does not aim to conform to the anatomical shape of a hand using a single yarn or multiple yarns.

U.S. Pat. No. 6,550,285 to Nishitani discloses yarn feeding apparatus. This apparatus minimizes fluctuation in tension of a knitting yarn and an accurate length of the knitting yarn is fed even if the amount of demand for the knitting yarn is suddenly changed. A knitting yarn is interposed between a main roller and a driven roller with yarn storage having a buffer rod, the angular inclination of which controls the storage. An angle sensor detects this angular inclination and uses a PID algorithm to predict the amount of knitting yarn demanded. The PID algorithm controls a servo-motor that drives the driven roller such that the tip portion of the buffer rod is brought to its original position at start of knitting. This device minimizes the fluctuations in knitting yarn tension due to sudden demand and is not programmed to alter the knitting yarn tension in order to adjust stitch dimensions.

U.S. Pat. Nos. 6,782,720, 6,782,721, and 6,823,699 to Vero et al. disclose unilayer fabric garment with reinforcing parts. A previously knit unilayer textile fabric is inserted with a heavier denier fiber at preselected areas of the fabric by a computer program. The inserted fiber is selected from the group consisting of S-glass fibers, E-glass fibers, steel filaments, carbon fibers, boron fibers, aluminum fibers, zirconium-silica fibers, aluminum-silica fibers, and mixtures thereof. The fabric article may be a garment or a glove providing the user with protection from abrasion cuts and punctures. The inserted fibers are high elastic modulus stiff fibers and presence of two fibers in a given region of a garment or glove compromises the flexibility at that location. Gloves with this reinforcement method are stiff and do not readily conform to the anatomy of user's hands.

U.S. Pat. No. 6,962,864 to Hardee, et al. discloses a knitted glove. This knitted glove is made by creating eight glove components having at least fifteen separate knitted sections altogether on a knitting machine. The glove includes five finger components made from at least two separately knitted sections for each finger component, two palm components, each of which is made from at least two separately knitted sections, and a wrist component made from at least one knitted section. Each component comprises a different stitch setup producing variable stitch dimensions and number of courses whereupon the glove has an overall shape that accommodates variations in size and shape of individual fingers and hands. The entire glove is knit with a single yarn and therefore does not have cut resistant properties or other property enhancements possible by using multiple yarns in different glove components.

Standard shape gloves or liners created by the prior art processes bring with them several disadvantages. First, the fit across finger knuckles and the center of the palm is tight, reducing glove or liner flexibility and ultimately reducing hand dexterity. Second, the standard gloves or liners tend to bag or gap in areas where the hand normally tapers; like the lower palm and wrist area; the excess fabric in the baggy areas can bunch and catch on protruding objects. Additionally, excess fabric at the lower palm created by the standard glove or liner shape causes an irregular foam line on those liners that are dipped in latex. Finally, the excess fabric at the lower palm of the standard glove or liner causes a high scrap rate in printing information on the gloves or liners. The problem is more severe when more than one fiber is used at any glove location resulting in a tighter, less flexible knit that does not provide a comfortable fit on the hand of the user.

In an attempt to solve these problems, knit gloves or liners can be made larger than standard size and shrunk by tumbling them in heat or using a laundry process to achieve a better fit. These processes as used on the larger gloves, however, may produce gloves that have improved fit across the knuckles, but do not address the excess fabric in areas where the hand normally tapers, like the lower palm and wrist, since the shrinkage is uniform across the glove.

Additionally, tumbling or a laundry process would require an additional manufacturing step as well as additional labor, both of which would increase the cost of the finished product. A standard tumbling process, using constant heat and time, would also fail to create the desired gloves and liners because of differences in thermal patterns in the tumbler and the heat sensitivity of fibers selected to knit the gloves and liners in a manufacturing operation. Further, these types of post-knitting processes would require additional development and manufacturing time to determine appropriate time and heat combinations to optimize the production of a particular glove or liner.

A glove with a selective second fiber, which may be cut resistant or of a different color that could be made to fit the contours of a human hand and that would not require post-knitting processing would therefore be an important improvement in the art.

BRIEF SUMMARY

The present invention is directed toward continuously knitted gloves and liners with selected glove area reinforcement with a fiber of different denier and different fiber properties. The methods of making these knitted gloves and liners comprise using continuous one or more yarns and an array of knitting needles suitable for the denier of the first yarn for the knitted glove. When a second yarn is introduced, the same single needle, which does the knitting of the glove, carries the first and second yarns together. When a selected area of the glove is completed, the second yarn is cut off, while the first yarn continues the knitting process. At a later time, when knitting a different selected area of the glove, the second yarn is added to the first yarn to create a knitted region with the two yarn fibers. The second yarn may have a heavier or lighter denier than the first yarn. The second yarn may have a different color compared to the first yarn. The second yarn may be cut resistant or abrasion resistant while the first yarn may be a soft fiber preferably with moisture absorbing properties. On the other hand, the first yarn may be cut resistant and the second yarn may be a non-performance fiber such as cotton or nylon. We have surprisingly found that when the second yarn has a heavier denier compared to the first yarn and the knit at a given glove area has increased stretchability, the heavier denier second yarn occupies on one side of the glove while the lighter denier yarn occupies the other side of the glove. If the heavier denier second yarn is cut resistant or abrasion resistant, and the lighter denier first yarn is moisture absorbing, a glove produced using knits with enhanced stretchability has moisture absorbing yarn fibers in contact with the skin of the user while the cut resistant fibers or abrasion resistant fibers are on the outer surface of the glove protecting the user's hand. If the heavier denier second yarn is of a bright color, the glove displays bright color at the selected area of the glove providing better visibility for these selected regions. For example, the finger tips of a glove may be of bright color indicating the location of these vulnerable finger tips in hazardous manufacturing operations. Further embodiments include the addition of a padded cuff section that can be formed from a non-performance yarn such as cotton or nylon. An additional section of the wrist component can thus be knitted to include only the non-performance yarn where the additional section is approximately the same length as a two-component first section of the wrist component so that the additional section can be folded into the glove and adhered adjacent to the first section of the wrist, by, for example, simply stitching an edge-securing stitch.

The invention relates to the fit of knitted gloves or liners on a human hand. Specifically, the stitch dimension and the number of courses used to knit each of the standard eight major glove components and their sections of the glove is altered to provide a glove geometry which is anatomically matched to a human hand, providing increased stretch capability in areas which flex during hand movement. This increased stretch capability provides the wearer with a tight fitting glove even when two fibers are present at a given glove region, which still provides comfortable glove feel and easy movement capability. These geometric alterations help conform the glove or liner to provide better fit on human hands. These alterations permit continuous knitting and manufacturing of gloves or liners with nearly perfect fit to the hand because of their tapered fingertips, expanded knuckles, tapered palm areas and expanded cuff width.

The stitch dimension in each course that is knitted determines the level of stretch available at that knitted course location. The number of courses determines the overall stretch of the fabric at a particular location in the glove. The stitch dimension has three discrete components, which may be changed or varied, individually or changed in combination under computer control of the flat knitting machine. A first embodiment of the stitch dimension comprises a stitch setup specification, which increases or decreases the depth of penetration of the knitting needle carrying the one or two yarns during knitting of fabric. Increasing the depth of penetration of the knitting needle brings in a larger length of the one or two knitting yarns in the knitted loop and the stitch thus formed can expand more than stitches knitted with smaller depth of penetration. If a full course is knitted with a deeper depth of penetration, that course can stretch more readily. If subsequent courses are knitted with the same depth of penetration the fabric knitted has a uniform stretch feel. However, if the depth of penetration of the knitting needle is progressively decreased, the fabric knitted has a stretch feel that decreases progressively. Therefore, the depth of penetration of the knitting needle provides a knitted fabric section of a glove that has 'designed in' stretch capability.

In a second embodiment of the stitch dimension, tension in the one or two yarns that are being knitted is increased or decreased under computer control. The one or two yarns are fed from spools and are clamped between a pair of pinch rollers, one of which may optionally be a computer controlled feeding roller. Due to the pinching action, the tension in the one or two yarns at the knitting head is not transmitted to the yarn spools. The computer controls the tension in the yarns in the segment between the pinch roller and the knitting head by means of a computer controlled tension adjustment mechanism. This adjustment mechanism may comprise a spiral spring carrying an arm through which each of the yarns pass. A spiral spring is attached to the arm and the other end of the spiral spring attached to a stepper motor. The computer rotates the stepper motor shaft, thereby increasing or decreasing the tension in the yarn in the segment between the pinch roller and the knitting head. The tension in the knit stitch limits its stretch capability. A full course stitched with increased tension has reduced stretch capability of that course. Accordingly, a fabric knitted with a number of courses with increased tension exhibits reduced stretch capability.

In a third embodiment of stitch dimension, a stitch may be missed in knitting a course. This decreases the overall stretch capability of the course. On the other hand, an additional stitch may be picked from the stitch to increase the overall length of a course to provide increased stretch capability. The stitch may have one yarn or two yarns being fed to the knitting needle.

The glove has eight components, four of which define the four fingers, two of which define the palm, one defining the thumb, and one defining the wrist. Each of these components is divided into one or more sections. In one embodiment, one or more of the finger components of the glove is divided into two or more sections. The upper and lower palm components are divided into two or more sections and the wrist component is made up of one or more sections, where each section is knitted using one or two yarns, a different stitch setup and each of the stitch setup is continued for a number of courses according to the desired geometrical shape of the glove. In another embodiment, each finger component of the glove is divided into three sections, and the upper and lower palm of the glove is divided into three sections, where each section is knitted using a different stitch setup and each of the stitch setup is continued for a number of courses according to the desired geometrical shape of the glove. In another embodiment, the upper and lower palm of the glove is divided into four sections, where each section is knitted using a different stitch setup and each of the stitch dimension is continued for a number of courses.

The course knitted with different stitch dimension essentially provides more yarn or less yarn at a given glove location providing enhanced or reduced stretch capability with a single yarn or two yarns included in the knitted stitch. The sections, which are required to have less stretch and therefore have a tight feel are made with stitches that incorporate a smaller length of yarn and/or at high tension or have one or more stitches less than the adjacent courses. Conversely, when a section requires increased stretch capability, the stitches are made with increased yarn length and/or with reduced tension or may have one or more stitches picked up in the courses compared to adjacent courses.

The invention also includes a method for manufacturing gloves and liners using variable stitch dimension and numbers of courses in each of the sections using one or two yarns within each of the eight major glove components to create a better fitting glove. These and other advantages of the invention will be apparent from the description of the invention provided herein.

DETAILED DESCRIPTION

Figure 1:
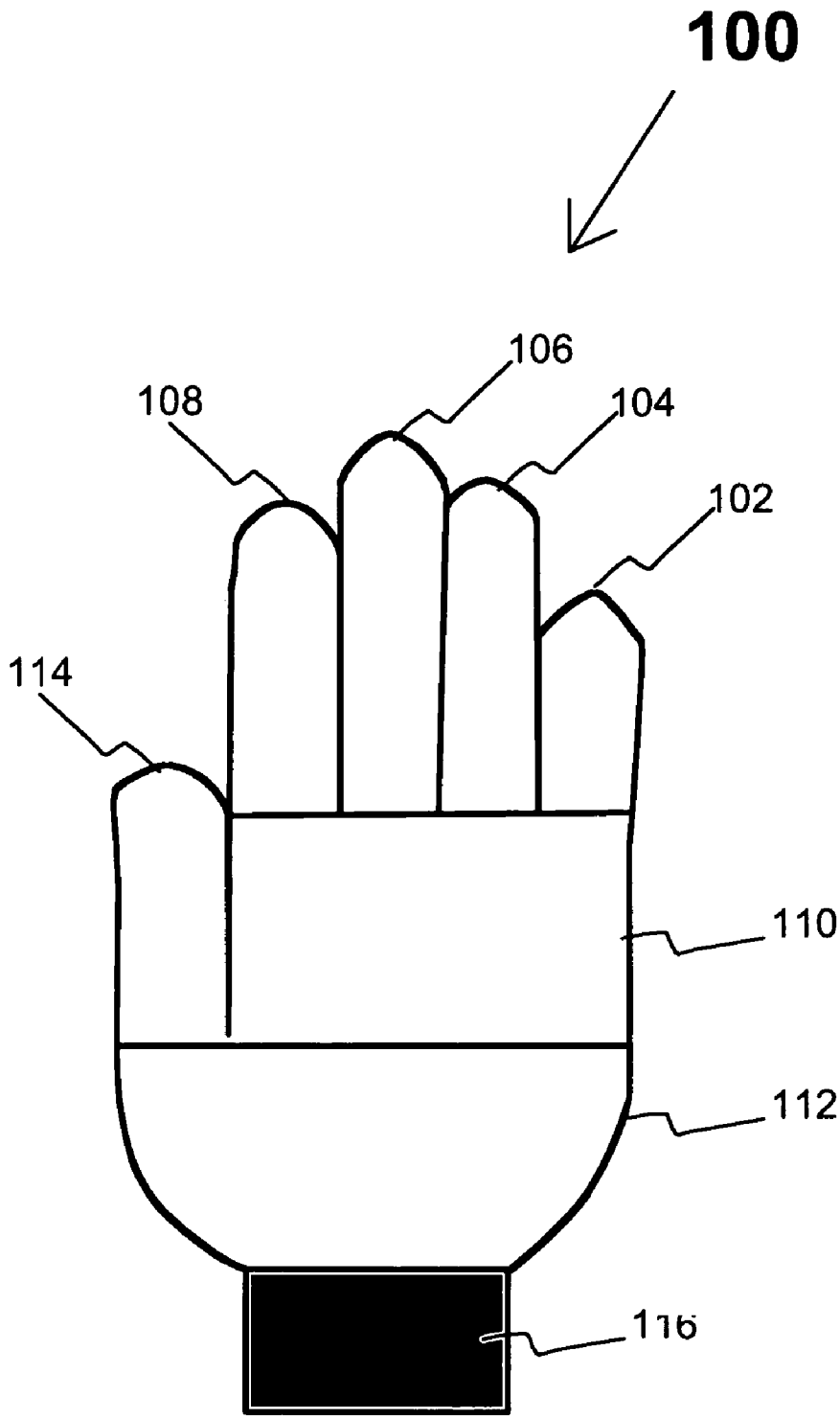
FIG. 1 shows a conventional prior art glove knitted using a standard number of courses and needles to create the standard eight components.

FIG. 1 illustrates a glove 100, having eight major glove components. These components include a pinky finger component 102, a ring finger component 104, a middle finger component 106, a forefinger component 108, an upper palm component 110, a lower palm component 112, a thumb component 114, and a wrist component 116. As can be seen in FIG. 1, the shape of the glove 100 fingers does not taper, nor does the wrist component 116 taper to prevent bagginess and gapping at the wrist. Additionally, the fingers of the glove 100 do not taper near the fingertips.

Existing flat knitting machines can be programmed to accommodate a large number of changes in stitch dimensions using stitch setup and alter the physical dimensions used in a standard eight component glove 100 of FIG. 1. Stitch setup can be used to "customize" gloves and liners manufactured in sizes 6, 7, 8, 9, and 10. They can also be used to develop specifications for finger length and width, palm length and width, and overall glove or liner length and width.

Figure 2:
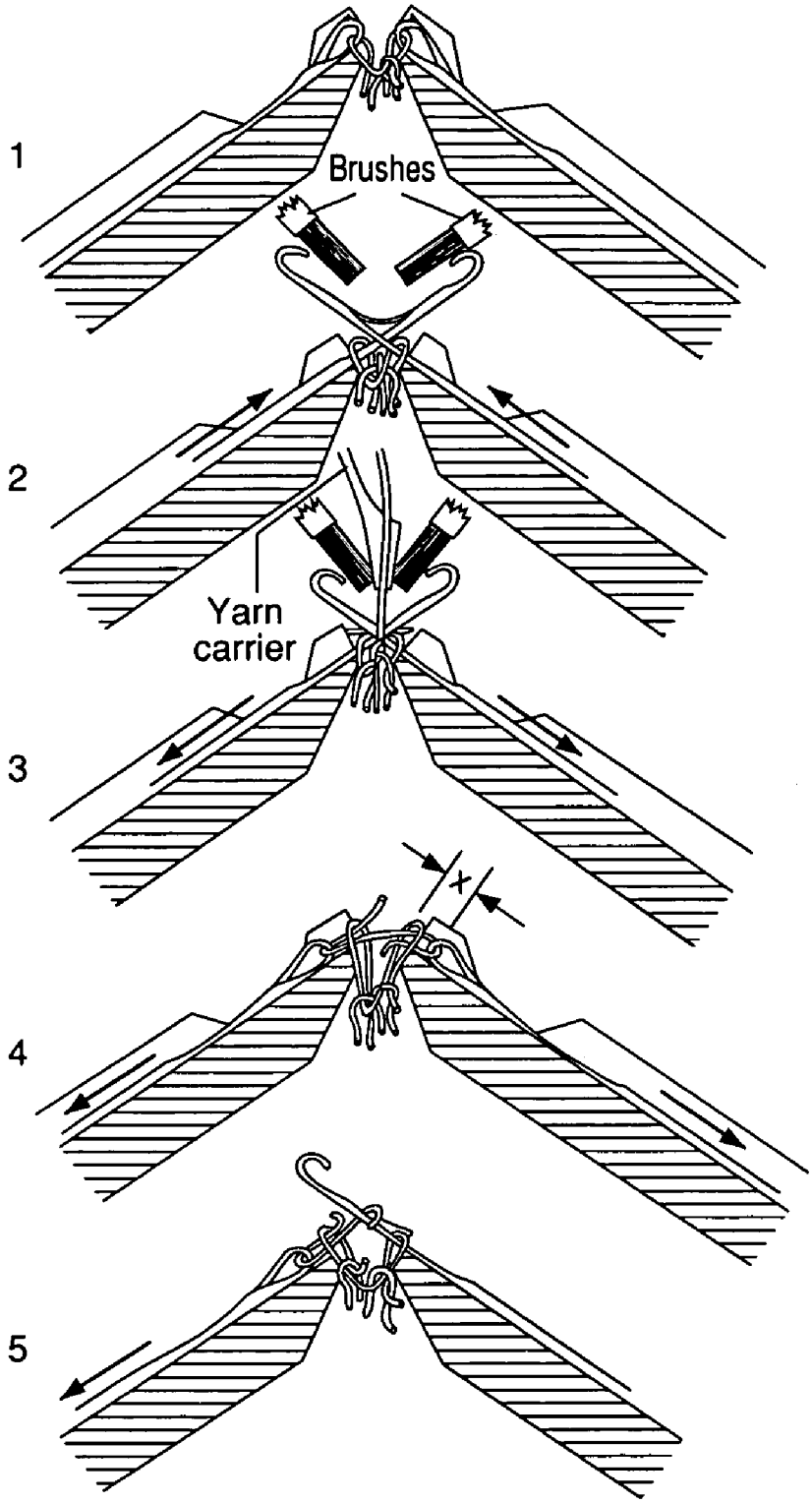
FIG. 2 shows the needle action in a knitting machine.

FIG. 2 shows the sequences involved in the knitting of a yarn in a V-bed flat knitting machine to create a knitted glove liner. The single knitting system cam-box is symmetrically designed for knitting a course of loops on both the front bed and back bed needles during a right to left traverse and a second course during return left to right cam box traverse. For each needle bed, there are two raising cams, two cardigan cams and two stitch cams. In the direction of traverse, the leading raising cam is responsible for knitting and the trailing raising cam acts as a guard cam. The leading stitch cam is raised out of action and the trailing stitch cam is in operation. The raising cam lifts the needle to tuck height, but if the cardigan cam above is in action, the needle is lifted to full clearing height. To produce a miss stitch, both the raising cam and the cardigan cam are out of action. This technology is well known and is illustrated in "Knitting Technology, a Comprehensive Handbook and Practical Guide" by David J. Spencer, published by Woodhead Publishing Limited, Cambridge, England, which is hereby incorporated by reference.

Figure 4A:
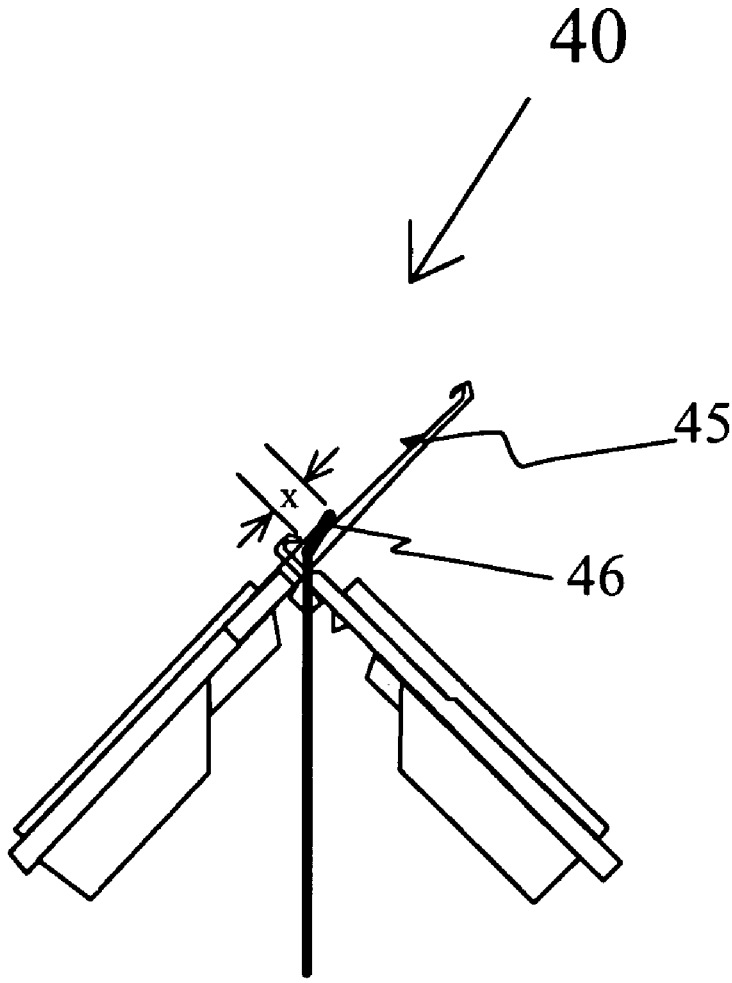
FIGS. 4*a* and 4*b* illustrate an embodiment of varying stitch dimension using a stitch setup wherein the needle penetration determines the length of yarn included in the stitch.
Figure 4B:
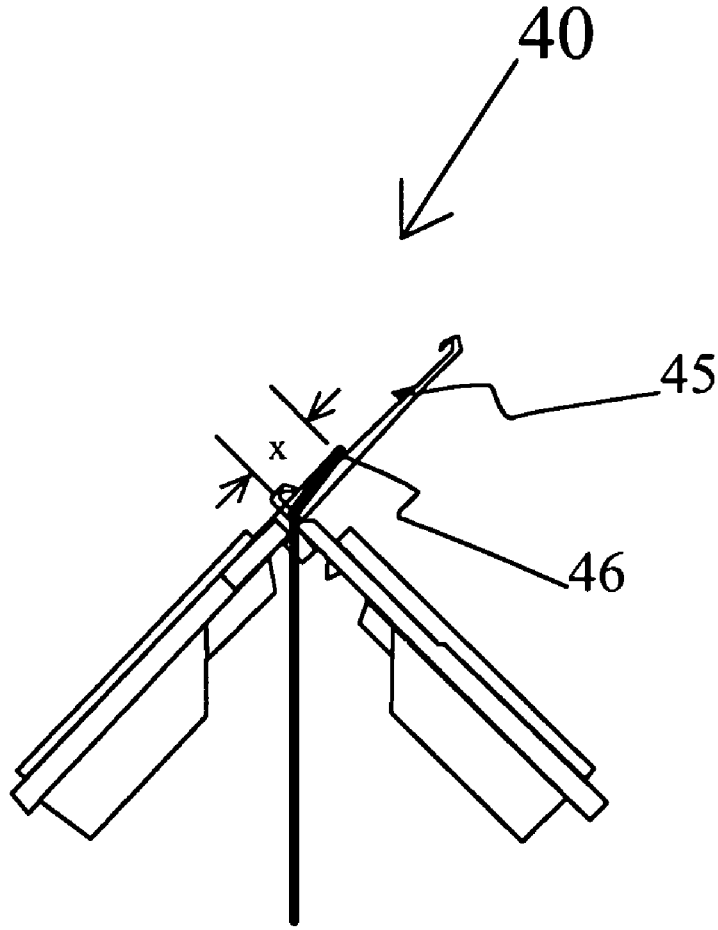

In FIG. 2, sequence 1 indicates the rest position. The tops of the heads of the needles are level with the edge of knock-over bits. The butts of the needles assume a straight line until contacting the rising cams because the leading stitch cams are lifted into an inactive position. The lifting cams alternate in actions and always lower the trailing stitch cam and raise leading stitch cam preventing straining of previously knitted loops. Sequence 2 indicates the clearing position. The needle butts are lifted as they contact the leading edges of the cams, which raises the needles. The needles are raised to full clearing height as their butts pass over the top of cardigan cams. Sequence 3 indicates yarn feeding. The yarn is fed as the needles descend under the control of guard cam shown in black color. The required loop length is drawn by each needle as it descends the stitch cam. This loop length is adjusted by stitch setup to draw more or less of the yarn to adjust the knitted stitch length as illustrated in FIGS. 4*a* and 4*b* shown below. Sequence 4 shows the knocking-over. To produce synchronized knocking-over of both needle beds are simultaneously, the stitch cam in the front system is set lower than the auxiliary stitch cam so that the later is rendered inactive. The dimension 'x' represents the stitch length. If delayed timing of knock-over is employed, as shown in sequence 5, the knock over of the front bed will occur after the knock over of the back bed.

Figure 3:
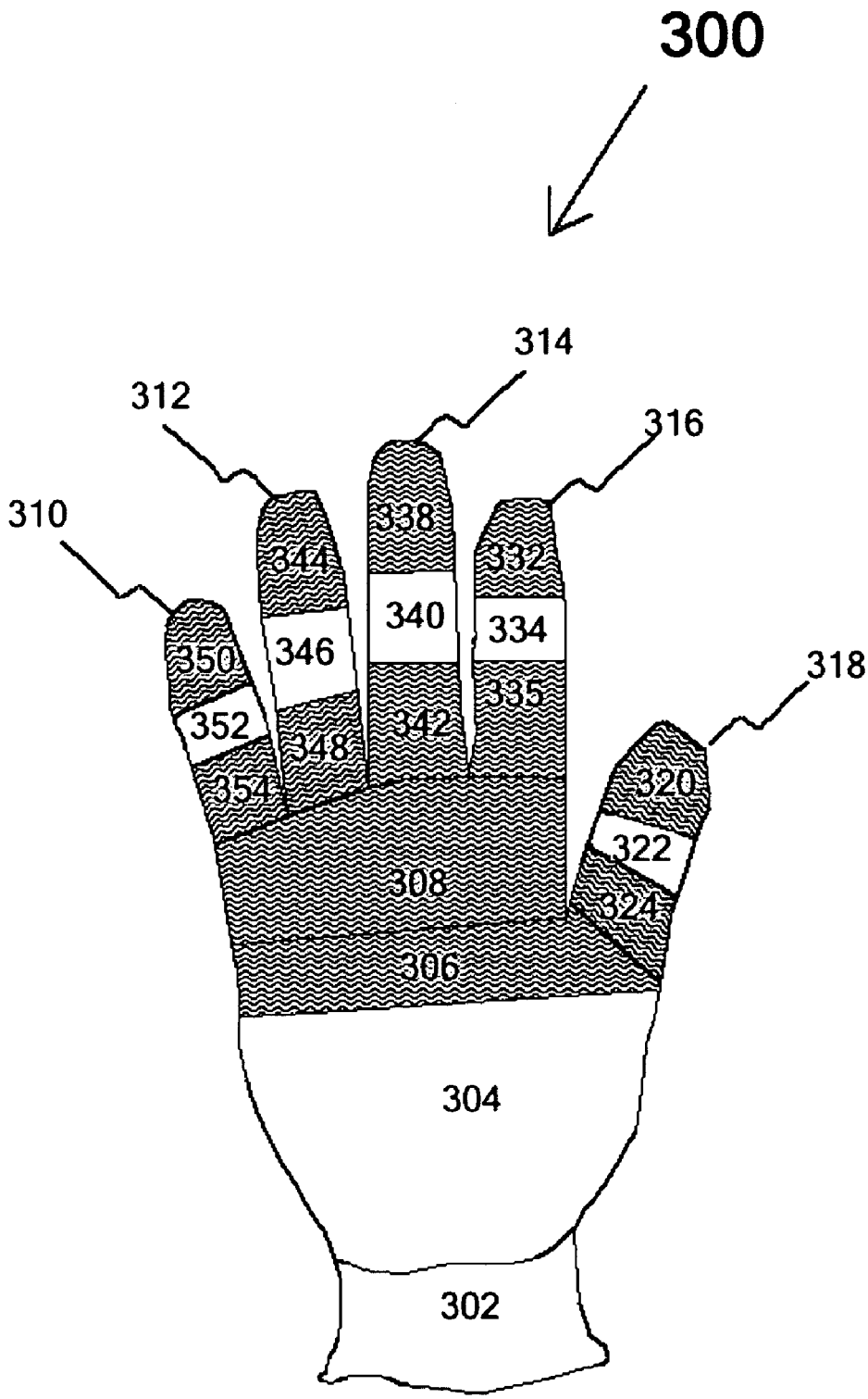
FIG. 3 shows an embodiment of a glove of the present invention.

FIG. 3 shows a glove 300 in accordance with one aspect of the present invention. This glove 300 includes nineteen total sections of the glove, including three sections for each of the finger components 310, 312, 314, 316, and thumb 318, three palm sections 304, 306, and 308, and one wrist section 302. Each of the finger components 310, 312, 314, 316, and 318 is knit according to three separate instructions for the knitting machine to create these three distinct areas designed to conform to the shape of fingers. These three sections are shown in FIG. 3 as sections 350, 352, and 354 for the pinky finger 310; sections 344, 346, and 348 for the ring finger 312; sections 338. 340 and 342 for the middle finger 314; sections 332, 334, and 336 for the forefinger 316; and sections 320, 322, and 324 for the thumb 318.

The glove 300 can be knit on a knitting machine and requires programming of the machine for each of the nineteen sections to control the stitch length. While controlled stitch stretch capability works well for single-layered fabrics with a single yarn passing through the knitting needle, the addition of a second layer formed by a second yarn passing concurrently through the knitting needle via plaiting or some other process will inherently decrease the stretch of the fabric. Using a variable plaiting process, double-layered functional zones are formed that increase the stretch in key flex areas of the gloves by altering the number of plated courses in each section. In Table 1, stretchable multi-layer functional zones are formed by plaiting a second functional yarn every fourth course in areas of low flex and then blending into a single-layer non-plated structure in areas of high flex. In Table 2, the same concept applies, but the functionality of the flexed areas of the zones is increased by adding a functional plaiting yarn every eighth course in sections where no second yarn was present. The use of every 4th and 8th course in the plaiting structure is for illustrative purposes only. The plaiting structure can range from every other course to every 9th course using the machines from Shima Seiki Mfg., Ltd. based in Wakayarna, Japan. The ultimate choice of plaiting course structure will be dependent on the properties of the functional yarn and the desired stretch of the functional zones.

For example, the glove 300 can be made according to the specifications provided in Table 1, which shows knit courses for each yarn used. Each of the components is indicated and their sections that match FIG. 3 are shown. Note that the courses begin with 1 for each component and continue through the sections. The stitch setup here shows a number, which indicates how deep the knitting needle penetrates. A lower number indicates less needle penetration while a larger number indicates that the needle penetrates deeper. For example, in component 1, which is the pinky finger, the first course has a knitting needle penetration depth of 37 in course 1 and increases gradually in a linear fashion to a knitting needle penetration depth of 39 at course 39. This means that course 1 is tighter to stretch than course 22 and the pinky finger is draped by the glove with the finger edge tight against the glove. This section 350 has yarn 1 always present, but yarn 2 being added in for every fourth course. Yarn 1 is indicated to be a nylon 6,6 yarn while yarn 2 is indicated to be a cut resistant Kevlar™/Lycra blend yarn. The second section of component 1 continues seamlessly with the same stitch setup of 39 maintaining the depth of penetration of the knitting needle. The second section has no yarn 2 present, meaning that the yarn is cut and picked up in section 3.

TABLE 1

| COMPONENT | STITCH SETUP | COURSES | SECTION IN EXAMPLE 1 | YARN 1* COURSES | YARN 2** COURSES |
|---|---|---|---|---|---|
| 1 | 37-39 | 1-22 | 350 | 1-22 | 1, 5, 9, 13, 17, 21 |
| | 39 | 23-58 | 352 | 23-58 | |
| | 39-37 | 59-88 | 354 | 59-88 | 59, 63, 67, 71, 75, 79, 83, 87 |
| 2 | 37-39 | 1-32 | 344 | 1-32 | 1, 5, 9, 13, 17, 21, 25, 29 |
| | 39 | 33-100 | 346 | 33-100 | |
| | 39-37 | 73-116 | 348 | 73-116 | 73, 77, 81, 85, 89, 93, 97, 101, 105, 109, 113 |
| 3 | 37-39 | 1-32 | 338 | 1-32 | 1, 5, 9, 13, 17, 21, 25, 29 |
| | 39 | 33-72 | 340 | 33-72 | |
| | 39-37 | 73-126 | 342 | 73-126 | 73, 77, 81, 85, 89, 93, 97, 101, 105, 109, 113, 117, 121, 125 |
| 4 | 37-39 | 1-32 | 332 | 1-32 | 1, 5, 9, 13, 17, 21, 25, 29 |
| | 39 | 33-72 | 334 | 33-72 | |
| | 39-37 | 73-116 | 336 | 73-116 | 73, 77, 81, 85, 89, 93, 97, 101, 105, 109, 113 |
| 5 | 37 | 1-32 | 308 | 1-32 | 1, 5, 9, 13, 17, 21, 25, 29 |
| 6 | 37-39 | 1-32 | 320 | 1-32 | 1, 5, 9, 13, 17, 21, 25, 29 |
| | 39 | 33-64 | 322 | 33-69 | |
| | 39-37 | 65-100 | 324 | 69-100 | 65, 69, 73, 77, 81, 85, 89, 93, 97 |
| 7 | 37 | 1-20 | 306 | 1-20 | 1, 5, 9, 13, 17 |
| | 36-22 | 21-70 | 304 | 21-70 | |
| 8 | 37 | 1-72 | 302 | 1-72 | |

*Yarn 1 is 2 ends of 2/70/34 Nylon 6,6 (280 denier)
Yarn 2 is 1 end of 16/1 (320 denier) Kevlar/Lycra blend For example, the glove 300 can be made according to the specifications provided in Table 2, which shows knit courses for each yarn used. Each of the components is indicated and their sections that match FIG. 3 are shown. Note that the courses begin with 1 for each component and continue through the sections. The stitch setup here shows a number, which indicates how deep the knitting needle penetrates. A lower number indicates less needle penetration while a larger number indicates that the needle penetrates deeper. For example, in component 1 which is the pinky finger the first course has a knitting needle penetration depth of 37 in course 1 and increases gradually in a linear fashion to a knitting needle penetration depth of 39 at course 39. This means that course 1 is tighter to stretch than course 22 and the pinky finger is draped by the glove with the finger edge tight against the glove. This section 350 has yarn 1 always present, but yarn 2 being added in for every 8th course. Yarn 1 is indicated to be a nylon 6,6 yarn while yarn 2 is indicated to be a cut resistant Kevlar™/Lycra blend yarn. The second section of component 1 continues seamlessly with the same stitch setup of 39 maintaining the depth of penetration of the knitting needle. The second section has yarn 2** in every 8th course as indicated.

TABLE 2

| COMPONENT | STITCH SETUP | COURSES | SECTION IN FIG. 3 | YARN 1* COURSES | YARN 2** COURSES |
|---|---|---|---|---|---|
| 1 | 37-39 | 1-22 | 350 | 1-22 | 1, 5, 9, 13, 17, 21 |
| | 39 | 23-58 | 352 | 23-58 | 23, 31, 39, 47, 55 |
| | 39-37 | 59-88 | 354 | 59-88 | 59, 63, 67, 71, 75, 79, 83, 87 |
| 2 | 37-39 | 1-32 | 344 | 1-32 | 1, 5, 9, 13, 17, 21, 25, 29 |
| | 39 | 33-72 | 346 | 33-72 | 33, 41, 49, 57, 65 |
| | 39-37 | 73-116 | 348 | 73-116 | 73, 77, 81, 85, 89, 93, 97, 101, 105, 109, 113 |
| 3 | 37-39 | 1-32 | 338 | 1-32 | 1, 5, 9, 13, 17, 21, 25, 29 |
| | 39 | 33-72 | 340 | 33-72 | 33, 41, 49, 57, 65 |
| | 39-37 | 73-126 | 342 | 73-126 | 73, 77, 81, 85, 89, 93, 97, 101, 105, 109, 113, 117, 121, 125 |
| 4 | 37-39 | 1-32 | 332 | 1-32 | 1, 5, 9, 13, 17, 21, 25, 29 |
| | 39 | 33-72 | 334 | 33-72 | 33, 41, 49, 57, 65 |
| | 39-37 | 73-116 | 336 | 73-116 | 73, 77, 81, 85, 89, 93, 97, 101, 105, 109, 113 |
| 5 | 37 | 1-32 | 308 | 1-32 | 1, 9, 17, 25 |
| 6 | 37-39 | 1-32 | 320 | 1-32 | 1, 5, 9, 13, 17, 21, 25, 29 |
| | 39 | 33-64 | 322 | 33-69 | 33, 41, 49, 57 |
| | 39-37 | 65-100 | 324 | 69-100 | 65, 69, 73, 77, 81, 85, 89, 93, 97 |
| 7 | 37 | 1-20 | 306 | 1-20 | 1, 5, 9, 13, 17 |
| | 36-22 | 21-70 | 304 | 21-70 | 21, 25, 29, 33, 37, 41, 45, 49, 53, 57, 61, 65, 69 |
| 8 | 37 | 1-72 | 302 | 1-72 | |

*Yarn 1 is 2 ends of 2/70/34 Nylon 6,6 (280 denier)
**Yarn 2 is 1 end of 16/1 (320 denier) Kevlar/Lycra blend This specification in Table 1 and Table 2 can be used on a New Shima Full Garment Machine (NSFG) with 15 gauge and 18 gauge needle sizes, which available from Shima Seiki Mfg., Ltd. based in Wakayarna, Japan to create a size 9 glove. The information for the stitch setup and the number of courses is entered into the knitting machine's operation system using a keypad and LED display. Adjustments may be made to the specifications in Table 1 to create gloves of different sizes. The gloves may be knit from different compositions of yarn, including cotton, Polyamide, polyester, polyolefin, acrylic, aramid, ultra high molecular weight (UHMW) polyethylene, liquid-crystal polymers, PBO, water-soluble fibers including polyvinyl alcohol, or metallic filaments. The yarns used to knit the gloves may be spun yarns, textured filament yarns, or multi-component composite yarns.

FIG. 4*a* illustrates at 40 a stitch knitted with a smaller stitch setup number. The knitting needle 45 penetrates to a smaller extent including a smaller loop of yarn 46 in the stitch providing only limited stretch capability. This figure indicates for clarity one yarn, however, two yarns may be used with exactly the same geometry. Dimension 'x' represents the smaller loop length of the stitch dimension.

FIG. 4*b* illustrates at 40 a stitch knitted with a larger stitch setup number. The knitting needle 45 penetrates to a larger extent including a larger loop of yarn 46 in the stitch providing only enhanced stretch capability. This figure indicates for clarity one yarn, however, two yarns may be used with exactly the same geometry. Dimension 'x' represents the larger loop length of the stitch dimension.

Figure 5:
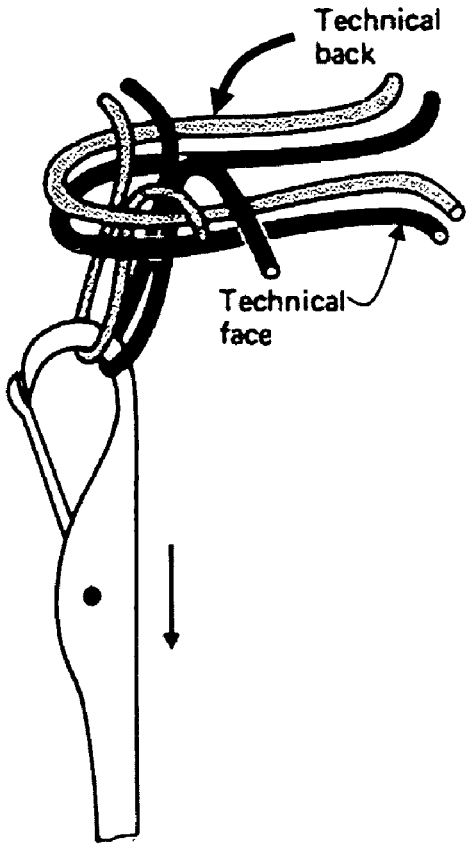
FIG. 5 shows the knitting needle with two yarns and the resultant knitted structure.
Figure 5:
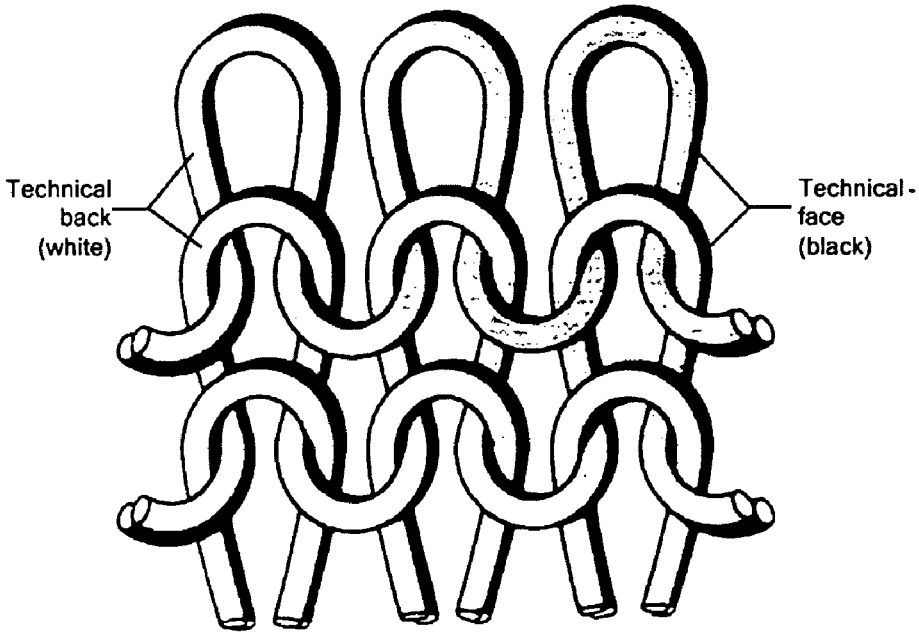

FIG. 5 illustrates a knitting needle with two differently colored yarns termed technical face and technical back. The technical face is a black yarn of a smaller denier while the technical back is a white yarn with a larger denier. The knitted structure, especially when the stitch setup produces a stretchable knit shows the smaller denier black yarn lying behind the larger denier white yarn.

Figure 6:
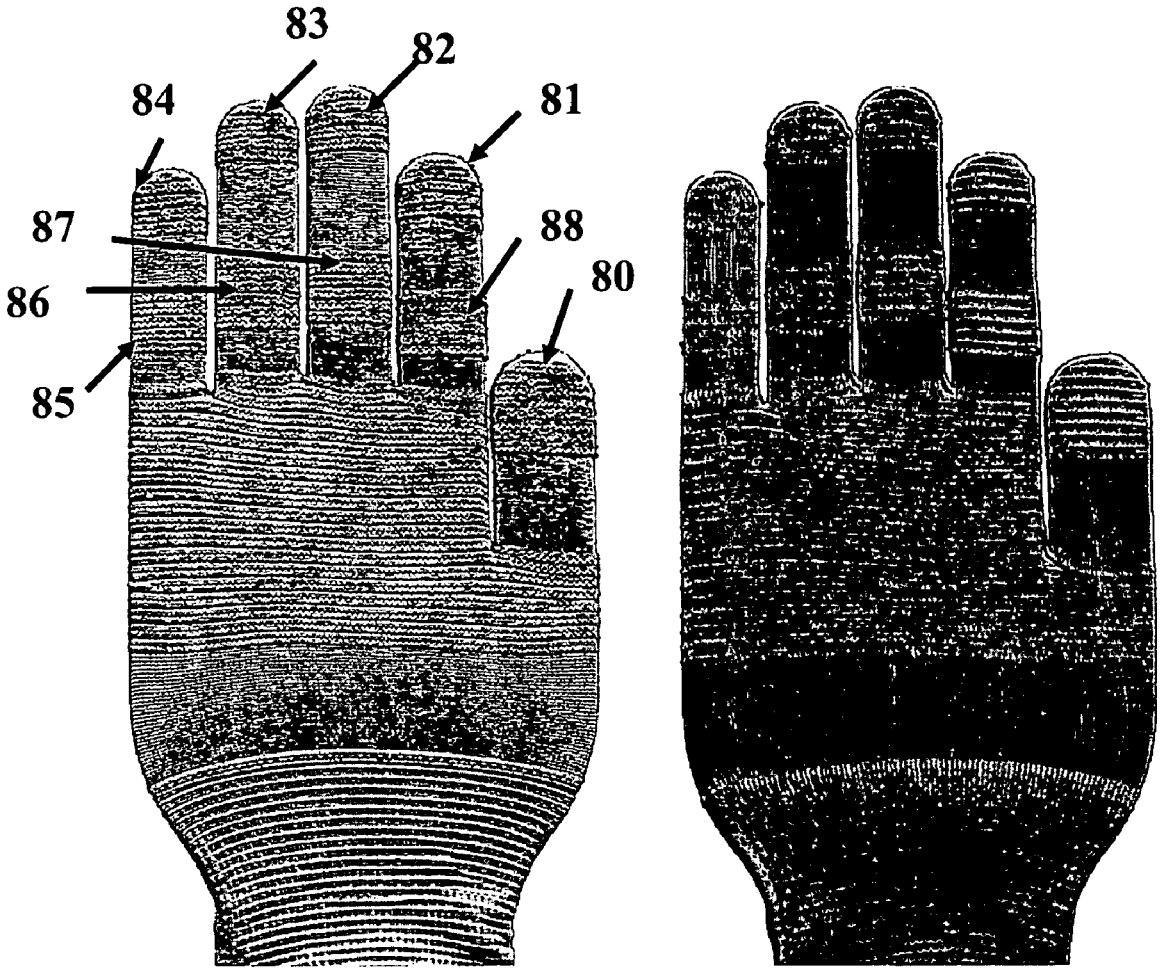
FIG. 6 shows a knitted glove with the two sides of knitted glove showing different colored yarns.

FIG. 6 is a copy of a photograph of a glove liner knitted according to the specification of Table 1 with a larger denier green yarn and a smaller denier gray yarn. The flexible portions of the glove between the digits of a finger comprise only one yarn, which is preferably gray in color. The tips of the fingers and the digits 80 to 84 are highlighted by a colored yarn, such as a green yarn. Due to the yarn separation as detailed in FIG. 5, the colored yarn only shows up on one side of the glove and is not visible when the glove is reversed inside out. When a transparent latex dip is used, these colors are clearly visible in a supported glove providing clear indication of vulnerable hand areas while working with hazardous industrial machinery. Other areas of the glove, such as 85 to 89, can also be made with a colored dye.

Figure 7:
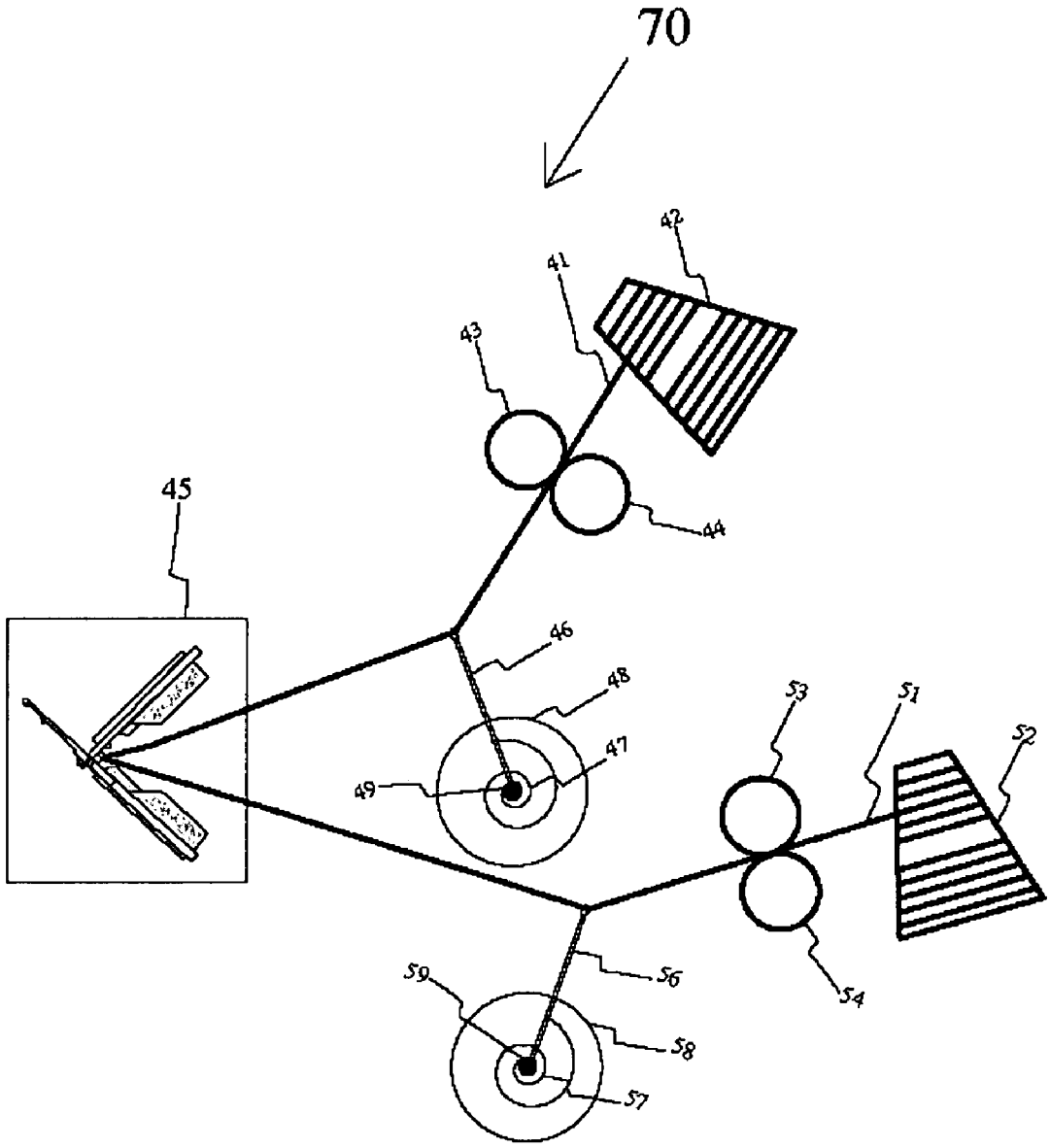
FIG. 7 shows the second embodiment of the stitch dimension wherein the computer controls the yarn feeding rollers and the tension in the yarns between the pinch roller and the knitting head.

FIG. 7 illustrates at 70 a first yarn 41 fed from a conical first yarn spool 42 through a pinch roller 43 and first yarn feed roller 44. The yarn 41 is supplied to the knitting head 45 through a tension control device comprising an arm 46 attached to a spiral spring 47 which is connected to a computer controlled stepper motor 48. Similarly, second yarn 51 is fed from a conical first yarn spool 52 through a pinch roller 53 and second yarn feed roller 54. The yarn 51 is supplied to the knitting head 45 through a tension control device comprising a arm 56 attached to a spiral spring 57 which is connected to a computer controlled stepper motor 58. The rotation of the stepper motor shaft 49 increases the tension provided by the spiral spring 47 enhancing the tension in the first yarn in the segment between the pinch roller 43 and knitting head 45. The second yarn tension is controlled in a similar manner. This variation in tension generated under computer control, incorporates a higher level of tension within the stitch limiting its stretch capability. The dimension of the stitch is independently controlled by the feed rollers 44 and 54, which is also controlled by the computer.

The varying stitch dimensions in the glove 300 allow the alteration of stitch dimension within a larger number of finger and palm sections than would be found in a standard glove 100. This increased number of sections benefits the glove by improving the degree to which it conforms to the shape of the hand, creating a better fit providing one or two yarns selected from cut resistant or abrasion resistant or colored yarns of different denier. In turn, this better fit provides increased dexterity and grip as well as increased long-term comfort in wearing the glove. In the present invention, stitch dimensions can be increasing in areas such as knuckles, which would require greater glove flexibility as fingers move.

Knitted stitch dimensions can be used to eliminate additional manufacturing steps that would be required in, for example, the use of heat or water to shrink gloves or liners to fit a particular hand size. This saves both money and time in the manufacturing process and does not require unique times, temperatures, or pressures. It also produces a more consistent product than one relying on difficult to control steps such as heat or tumbling.

A small study has been conducted to compare glove flexibility and resulting hand dexterity of standard shape gloves as compared to gloves of this invention. Subjects in the study assembled eight sets of five different nut and screw sizes while wearing the standard glove and while wearing the knitted variable stitch glove of this invention. Each subject in the study showed a decrease in the time it took to assemble the set of nuts and screws when wearing the gloves of this invention. In the study, decreases in time ranged from 13.9% to 20.3% less time for participants to assemble the sets of screws and nuts wearing the gloves of the present invention than while wearing standard knitted gloves. This study shows that the glove of this invention improved the fit of the knitted gloves such that it increased dexterity and grip over the standard glove.

Figure 8:
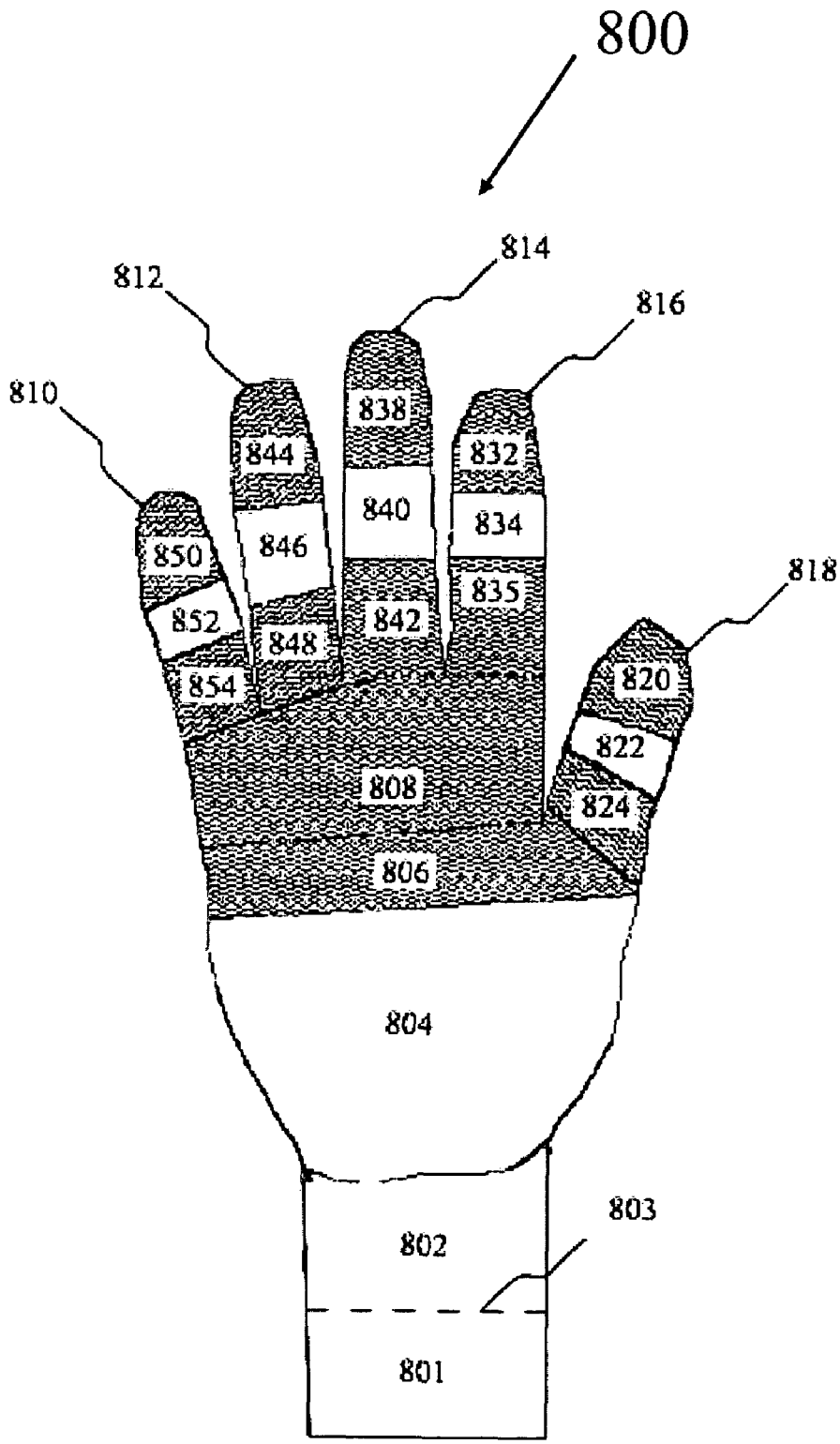
FIG. 8 shows another embodiment of a glove of the present invention.

FIG. 8 shows a glove 800 in accordance with one aspect of the present invention. This glove 800 includes twenty total sections of the glove, including three sections for each of the finger components 810, 812, 814, 816, and thumb 818, three palm sections 804, 806, and 808 and two wrist sections 801 and 802. Each of the finger components 810, 812, 814, 816, and 818 is knit according to three separate instructions for the knitting machine to create these three distinct areas designed to conform to the shape of fingers. These three sections are shown in FIG. 8 as sections 850, 852, and 854 for the pinky finger 810; sections 844, 846, and 848 for the ring finger 812; sections 838. 840, and 842 for the middle finger 814; sections 832, 834, and 836 for the forefinger 816; and sections 820, 822, and 824 for the thumb 818. For the wrist component, sections 801 and 802 are knitted without any varying stitch dimensions. Section 802 includes two yarns, for example a cut resistant yarn and a plaited yarn such as nylon. These yarns are then removed from the knitting machine and a yarn 803, such as a dyed polyester yarn used to designate size or the like, can be used to separate section 802 from 801. Section 801 is knitted by inserting the previously used plaited yarn alone or by inserting a different yarn, such as cotton. A plurality of stitches of substantially similar length to section 802 is then knitted. Section 801 is then folded at approximately 803 into the glove and stitched or otherwise adhered to section 802 to form a padded cuff.

The knitted gloves of this invention, once finished, may also be coated either on the outside or inside with a coating such as natural rubber latex or synthetic rubber latex, as well as other elastomeric polymer coatings, for example, synthetic polyisoprene, carboxylated acrylonitrile butadiene, non-carboxylated acrylonitrile butadiene, butyl latex, polychloroprene, water-based polyurethane, solvent-based polyurethane, or combinations thereof. The coating may be applied by dipping the knitted glove of this invention into the coating material or by spraying the coating onto the glove. Coating the knitted gloves of this invention can improve the grip of the glove in handling dry and oily items when the coating is on the outside of the glove. The addition of a coating to the knitted layer can also improve the quality of the glove as an insulator.

The coating may be foamed as desired. A detailed embodiment includes the use of a foamed nitrile.

Although only a few exemplary embodiments of the present invention have been described in detail above, those skilled in the art will readily appreciate that many modifications are possible in the exemplary embodiments without materially departing from the novel teachings and advantages of this invention. For example, the number of sections of the glove may be increased or decreased to adjust the fit of the glove without departing from the spirit of the present invention. Accordingly, all such modifications are intended to be included within the scope of this invention as defined in the following claims.

The use of the terms "a" and "an" and "the" and similar referents in the context of describing the invention (especially in the context of the following claims) are to be construed to cover both the singular and the plural unless otherwise indicated herein or clearly contradicted by context. Recitation of ranges of values herein are merely intended to serve as a shorthand method of referring individually to each separate value falling within the range; unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g. "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A knitted glove comprising eight glove components and at least fifteen sections such that:

four finger components each has at least two separate knitted sections;

a thumb component has at least two separate knitted sections;

two palm components each has at least two separate knitted sections; and a wrist component has at least one knitted section;

wherein at least one section of each of the finger components, the thumb component, and the palm component comprises a cut resistant yarn knitted to form a first plurality of knitted stitches being knitted with varying stitch dimensions over a first plurality of stitch courses, and wherein at least one section of each component comprises the cut resistant yarn and a plaited yarn, the yarns being knitted simultaneously to form a plaited structure wherein the plaited yarn resides on one surface of the glove, thereby producing a glove having an overall shape that accommodates variations in size and shape of individual fingers and hands.

2. The glove of claim 1, wherein the second yarn comprises nylon.

3. The glove of claim 1, wherein the wrist component further comprises a second section knitted from a soft, non-performance yarn knitted to form a comfortable padded cuff that can be folded into the glove, thereby contacting the wrist of the user.

4. The glove of claim 1, wherein the soft, non-performance yarn comprises cotton, nylon, or both.

5. The glove of claim 1, wherein the varying stitch dimensions over the first plurality of stitch courses, the second plurality of stitch courses, or both are controlled by a computer.

6. The glove of claim 1, wherein the varying stitch dimensions over the first plurality of stitch courses, the second plurality of stitch courses, or both are achieved by casting off one or more stitches or picking up additional stitches according to a desired shape of a glove section.

7. The glove of claim 1, wherein the varying stitch dimensions over the first plurality of stitch courses, the second plurality of stitch courses, or both are controlled by a stitch setup that sets penetration of a knitting needle into a fabric being knit.

8. The glove of claim 1, wherein the varying stitch dimensions are controlled by a computer adjusting tension of the cut resistant yarn, the second yarn, or both between a knit head and pinch roll by a mechanism controlled by a computer.

9. The glove of claim 1, wherein the cut resistant yarn comprises aramid, ultra high molecular weight polyethylene, a liquid-crystal polymer, a metallic filament, or combinations thereof.

10. The glove of claim 1, further comprising a coating of an elastomeric polymer material.

11. The glove of claim 10, where the elastomeric polymer material is chosen from the group consisting of natural rubber, synthetic polyisoprene, carboxylated acrylonitrile butadiene, non-carboxylated acrylonitrile butadiene, butyl latex, polychloroprene, water-based polyurethane, solvent-based polyurethane, or combinations thereof.

12. A method making a knitted glove, the method comprising the steps of programming a knitting machine to knit a glove comprising:

eight glove components and at least fifteen sections such that:

four finger components each has at least two separate knitted sections;

a thumb component has at least two separate knitted sections;

two palm components each has at least two separate knitted sections; and a wrist component has at least one knitted section;

wherein at least one section of each of the finger components, the thumb component, and the palm component comprises a cut resistant yarn knitted to form a first plurality of knitted stitches being knitted with varying stitch dimensions over a first plurality of stitch courses, and wherein at least one section of each component comprises the cut resistant yarn and a plaited yarn, the yarns being knitted simultaneously to form a plaited structure wherein the plaited yarn resides on one surface of the glove, thereby producing a glove having an overall shape that accommodates variations in size and shape of individual fingers and hands.

13. The method of claim 12, comprising using a computer to control the varying stitch dimensions.

14. The method of claim 12, comprising casting off one or more stitches or picking up additional stitches according to desired shape of a glove section to achieve varying stitch dimensions.

15. The method of claim 12, comprising controlling a stitch setup that sets penetration of a knitting needle into a fabric being knit.

16. The method of claim 12, wherein the varying stitch dimensions are controlled by a computer adjusting tension of the cut resistant yarn, the second yarn, or both between a knit head and pinch roll by a mechanism controlled by a computer.

17. The method of claim 12, further comprising coating the glove with an elastomeric polymer material selected from natural rubber latex, synthetic polyisoprene, carboxylated acrylonitrile butadiene, non-carboxylated acrylonitrile butadiene, butyl latex, polychloroprene, water-based polyurethane, solvent-based polyurethane, or combinations thereof.

18. The method of claim 12 further comprising forming a padded cuff by forming a second section of the wrist component from a soft, non-performance yarn and by folding the second section into the glove.

19. A knitted glove comprising eight glove components and at least fifteen sections such that:

four finger components each has at least two separate knitted sections;

a thumb component has at least two separate knitted sections;

two palm components each has at least two separate knitted sections; and a wrist component has at least two knitted sections;

wherein at least one section of each of the finger components, the thumb component, and the palm component comprises an aramid yarn knitted to form a first plurality of knitted stitches being knitted with varying stitch dimensions over a first plurality of stitch courses, and wherein at least one section of each component comprises the aramid yarn and a first nylon yarn that has a lighter denier than the aramid yarn, the yarns being knitted simultaneously to form a plaited structure wherein the first nylon yarn resides on one surface of the glove, wherein one section of the wrist component comprises a cotton or nylon yarn to form a padded cuff, thereby producing a glove having an overall shape that accommodates variations in size and shape of individual fingers and hands and provides a comfortable fit in the wrist area.

20. The glove of claim 19, further comprising a coating of an elastomeric polymer material of nitrile.

* * * * *